US010726749B1

(12) United States Patent
Narcisse

(10) Patent No.: US 10,726,749 B1
(45) Date of Patent: Jul. 28, 2020

(54) TRIFOLD PRESENTATION BOARD ASSEMBLY

(71) Applicant: Gregg Narcisse, Crete, IL (US)

(72) Inventor: Gregg Narcisse, Crete, IL (US)

( * ) Notice: Subject to any disclaimer, the term of this patent is extended or adjusted under 35 U.S.C. 154(b) by 0 days.

(21) Appl. No.: 16/538,983

(22) Filed: Aug. 13, 2019

(51) Int. Cl.
*G09F 15/00* (2006.01)
*B43L 1/04* (2006.01)
*B43L 1/00* (2006.01)

(52) U.S. Cl.
CPC ..... *G09F 15/0062* (2013.01); *B43L 1/00* (2013.01); *B43L 1/04* (2013.01); *G09F 15/0018* (2013.01)

(58) Field of Classification Search
CPC .... G09F 15/0062; G09F 15/0018; G09F 7/00; B43L 1/00; B43L 1/04
See application file for complete search history.

(56) References Cited

U.S. PATENT DOCUMENTS 2,867,045 A * 1/1959 Millgate ..... G09B 5/02 434/426
3,629,960 A * 12/1971 Roush ..... A47B 41/06 434/429
4,919,259 A * 4/1990 Beaulieu ..... A45C 7/0054 16/225
5,269,524 A * 12/1993 Womack ..... A63F 3/0023 273/157 R
5,775,919 A * 7/1998 Gardner ..... B43L 1/04 40/594
5,960,848 A 10/1999 Schirer
5,984,092 A * 11/1999 Heard-Willmon ..... A45C 13/02 206/232
6,189,594 B1 * 2/2001 Carter ..... A45C 9/00 160/135
6,772,816 B2 8/2004 Carter
6,799,337 B1 * 10/2004 Raphael-Davis ..... A47D 7/00 5/658
7,040,899 B2 * 5/2006 Armstrong ..... A47F 7/14 160/135
D560,072 S 1/2008 Willis
7,451,800 B2 * 11/2008 Johnson ..... G09F 15/0068 160/135
7,823,309 B2 11/2010 Albenda
8,245,423 B2 * 8/2012 Goslee ..... B42F 7/08 40/388
10,163,378 B1 * 12/2018 McGrath ..... G09F 15/0062
2004/0148832 A1 * 8/2004 Albenda ..... G09F 1/06 40/610
2006/0214922 A1 * 9/2006 Moore ..... B43L 1/00 345/173

(Continued)

*Primary Examiner* — Gary C Hoge

(57) ABSTRACT

A trifold presentation board assembly for securing and protecting a display includes a panel that comprises a first section and a pair of second sections. Each second section is hingedly coupled to a respective opposing edge of the first section and is positioned to be pivoted relative to the first section to selectively reposition the panel from an extended configuration to a folded configuration. A forward face of each of the second sections is positioned proximate to a front face of the first section so that the pair of second sections covers the front face of the first section. A plurality of couplers that is coupled to a rear surface of the panel is positioned to be selectively mutually coupled when the panel is in the folded configuration. The panel is configured to shield and protect a display article that is coupled to a front surface of the panel.

13 Claims, 8 Drawing Sheets

(56) References Cited

U.S. PATENT DOCUMENTS

| | | | | |
|---|---|---|---|---|
| 2007/0102384 | A1* | 5/2007 | Albenda | A47B 96/202<br>211/85.26 |
| 2008/0286744 | A1* | 11/2008 | Cheris | B43K 23/002<br>434/408 |
| 2010/0279580 | A1* | 11/2010 | Sanford | A63H 33/38<br>446/147 |
| 2014/0259535 | A1* | 9/2014 | Owens | A45F 5/10<br>16/430 |
| 2016/0136472 | A1* | 5/2016 | Kwo | A63B 1/00<br>482/38 |
| 2018/0258965 | A1* | 9/2018 | Danko | F16B 5/0084 |
| 2019/0092087 | A1* | 3/2019 | Schorr, III | G09F 19/00 |

* cited by examiner

TRIFOLD PRESENTATION BOARD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to presentation board assemblies and more particularly pertain to a new presentation board assembly for securing and protecting a display.

BRIEF SUMMARY OF THE INVENTION

An embodiment of the disclosure meets the needs presented above by generally comprising a panel that comprises a first section and a pair of second sections. Each second section is hingedly coupled to a respective opposing edge of the first section and is positioned to be pivoted relative to the first section to selectively reposition the panel from an extended configuration to a folded configuration. A forward face of each of the second sections is positioned proximate to a front face of the first section so that the pair of second sections covers the front face of the first section. A plurality of couplers that is coupled to a rear surface of the panel is positioned to be selectively mutually coupled when the panel is in the folded configuration. The panel is configured to shield and protect a display article that is coupled to a front surface of the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

Figures 9, 9A, 9B, 9C:
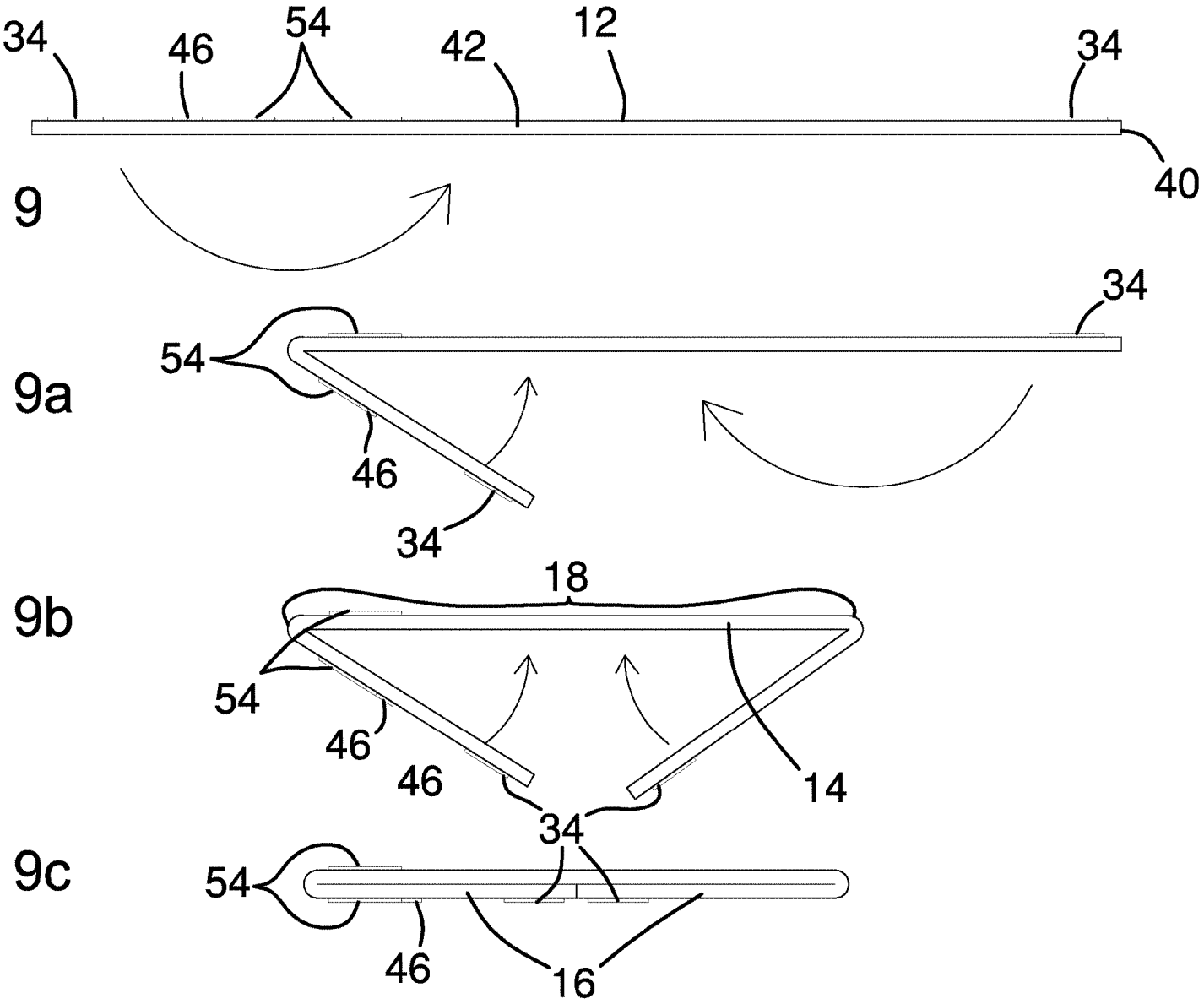

FIGS. 9-9*c* are incremental folding views of an embodiment of the disclosure.

Figure 10:
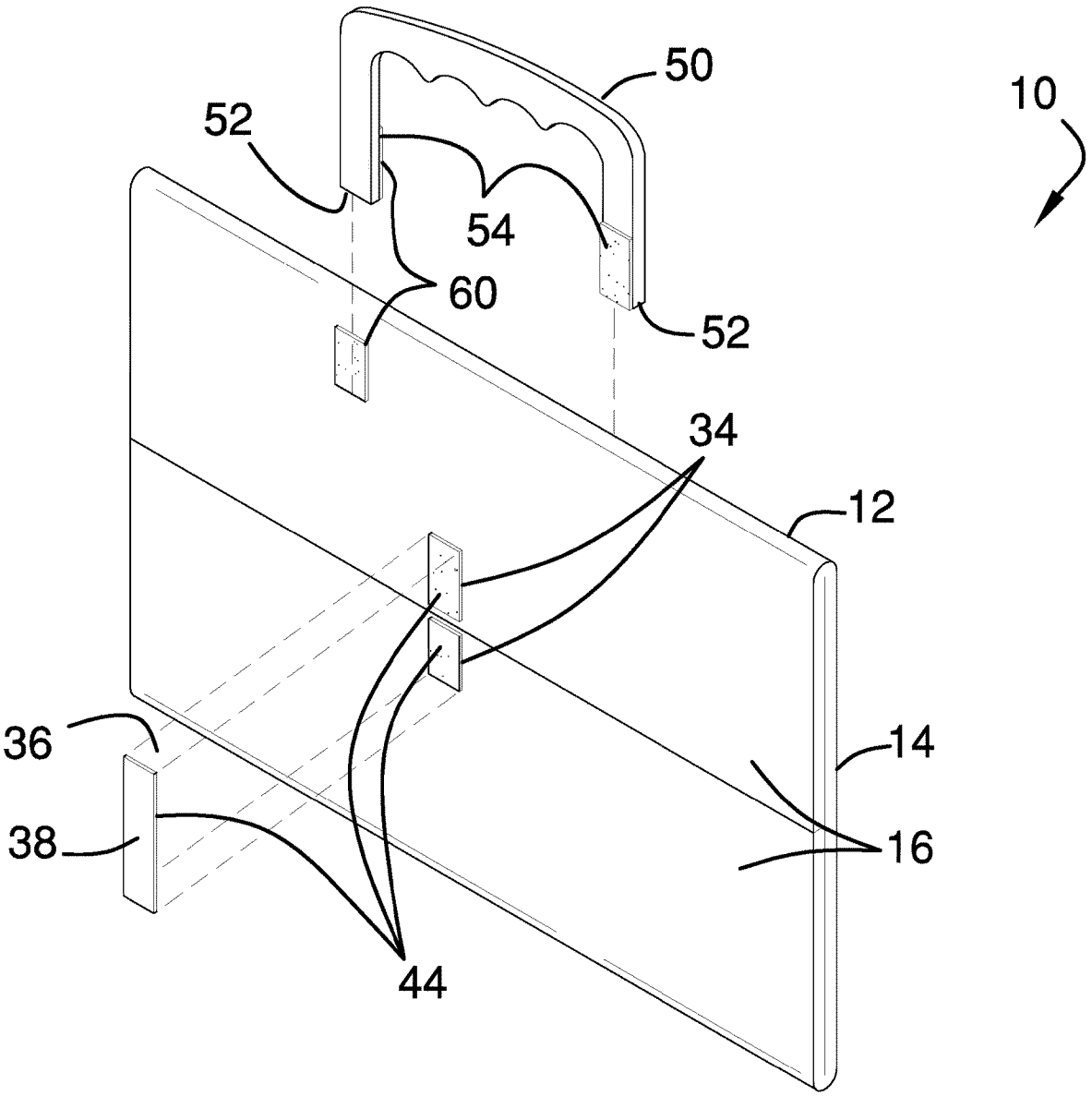

FIG. 10 is an exploded view of an embodiment of the disclosure.

DETAILED DESCRIPTION OF THE INVENTION

With reference now to the drawings, and in particular to FIGS. 1 through 10 thereof, a new presentation board assembly embodying the principles and concepts of an embodiment of the disclosure and generally designated by the reference numeral 10 will be described.

Figure 1:
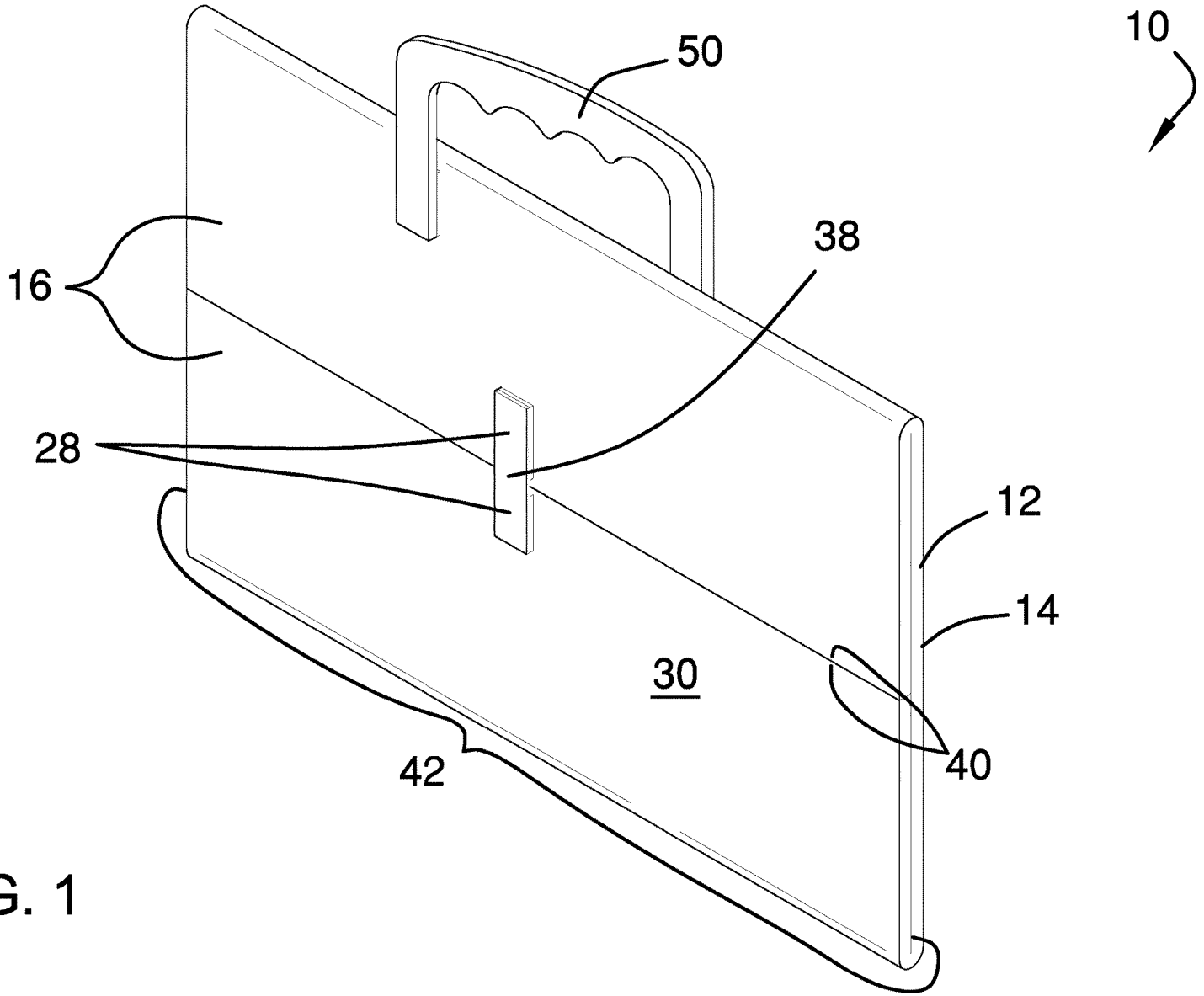
FIG. 1 is a folded isometric perspective view of a trifold presentation board assembly according to an embodiment of the disclosure.
Figure 2:
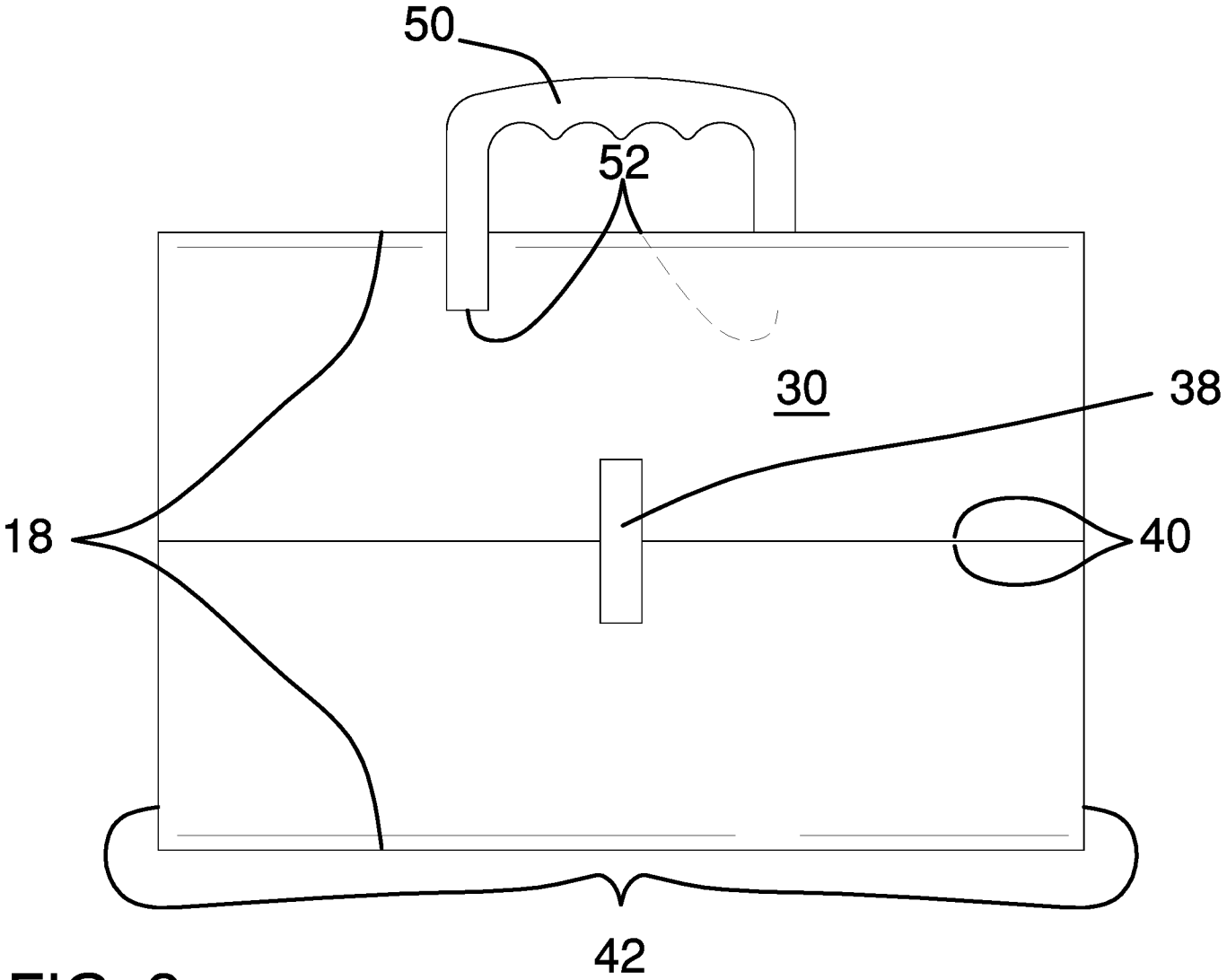
FIG. 2 is a front folded view of an embodiment of the disclosure.
Figure 3:
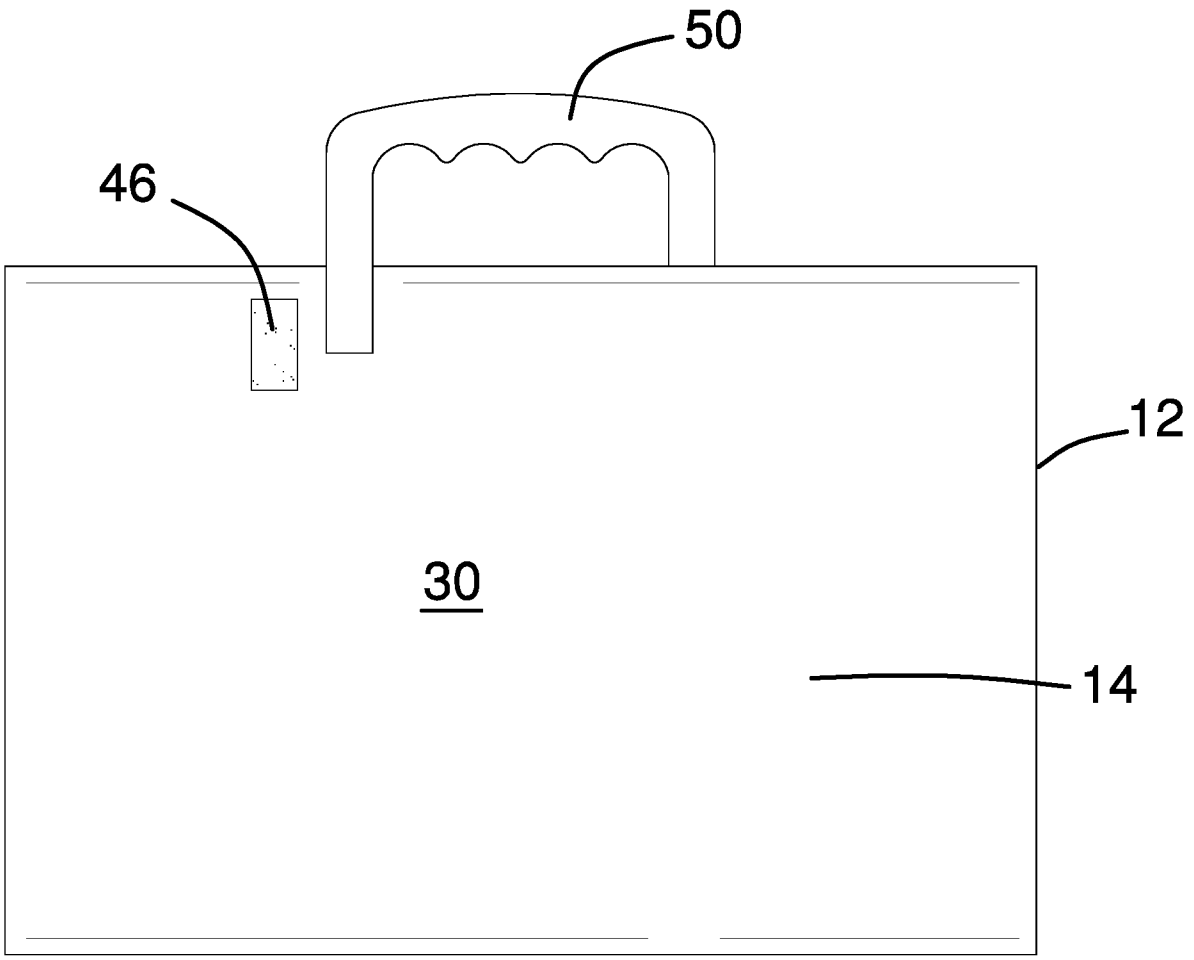
FIG. 3 is a rear folded view of an embodiment of the disclosure.
Figure 5:
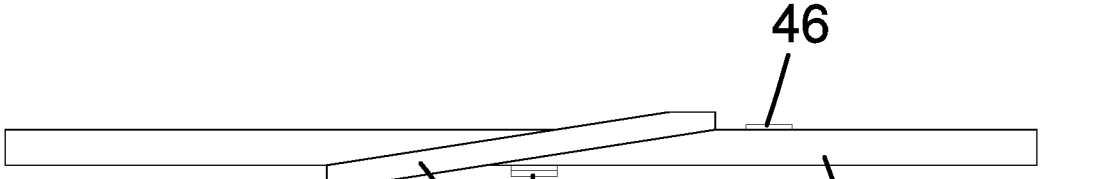
FIG. 5 is a top side folded view of an embodiment of the disclosure.
Figure 6:
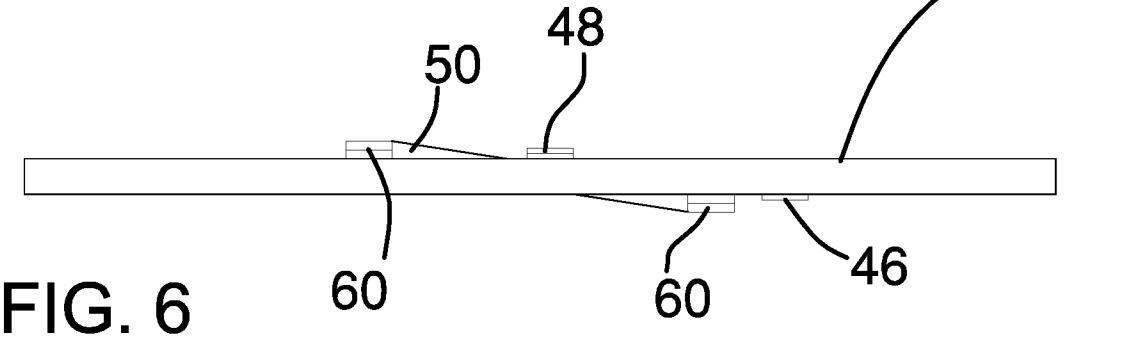
FIG. 6 is a bottom side folded view of an embodiment of the disclosure.
Figure 4:
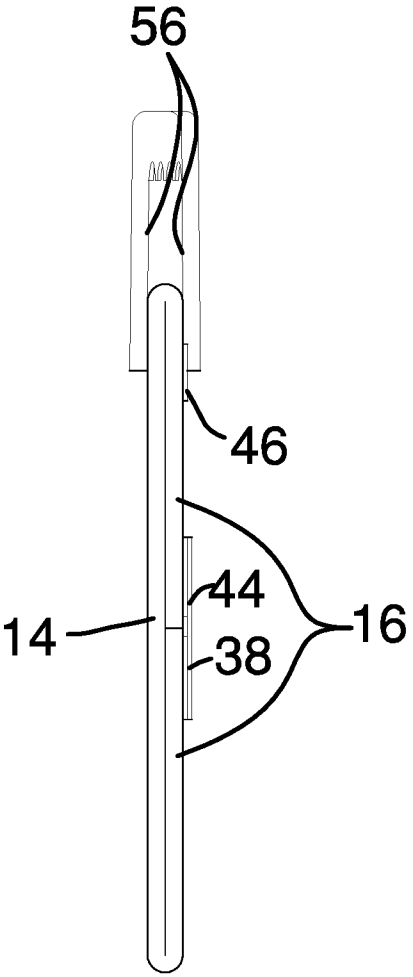
FIG. 4 is an end folded view of an embodiment of the disclosure.
Figure 7:
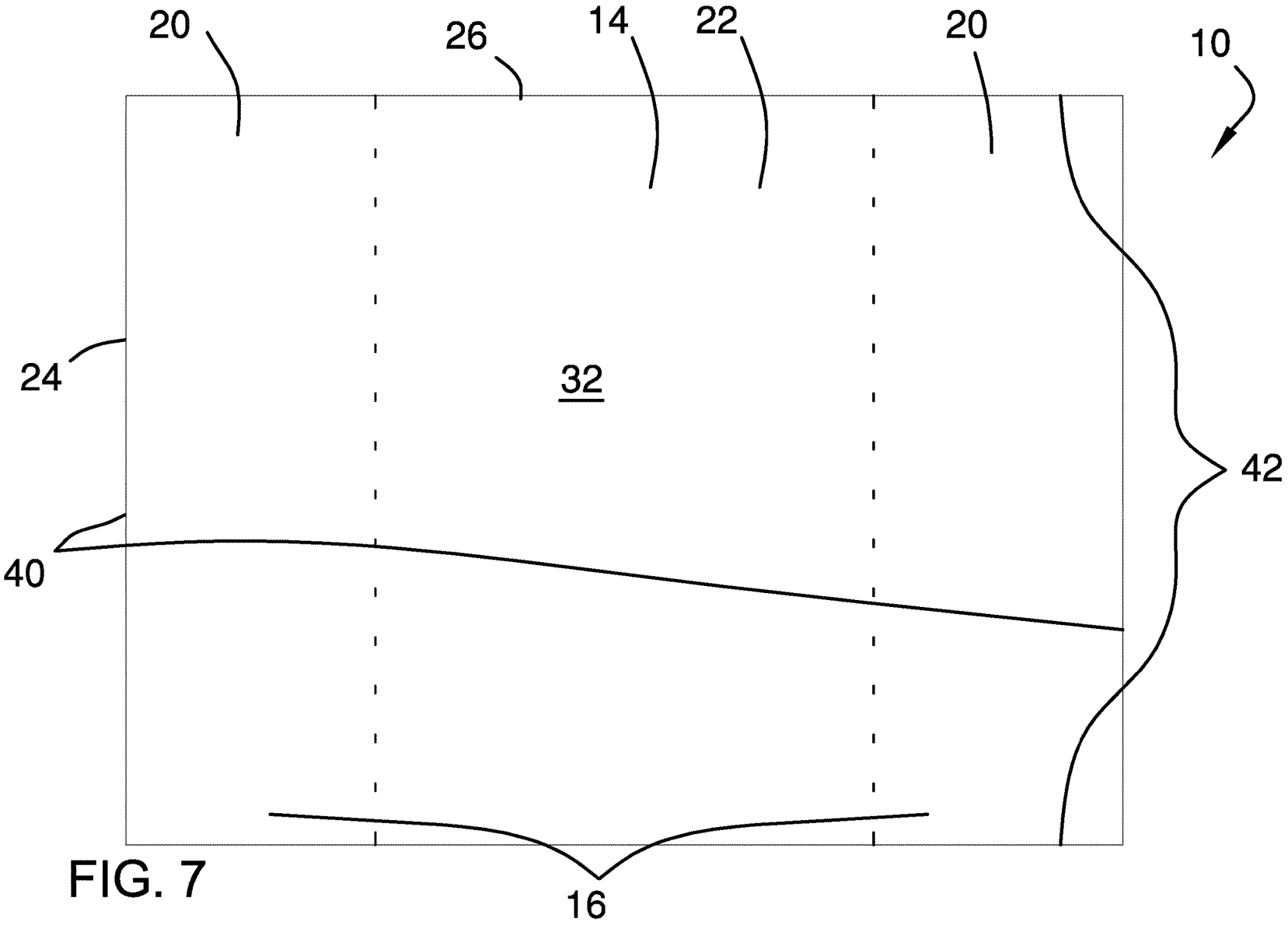
FIG. 7 is a front open view of an embodiment of the disclosure.
Figure 8:
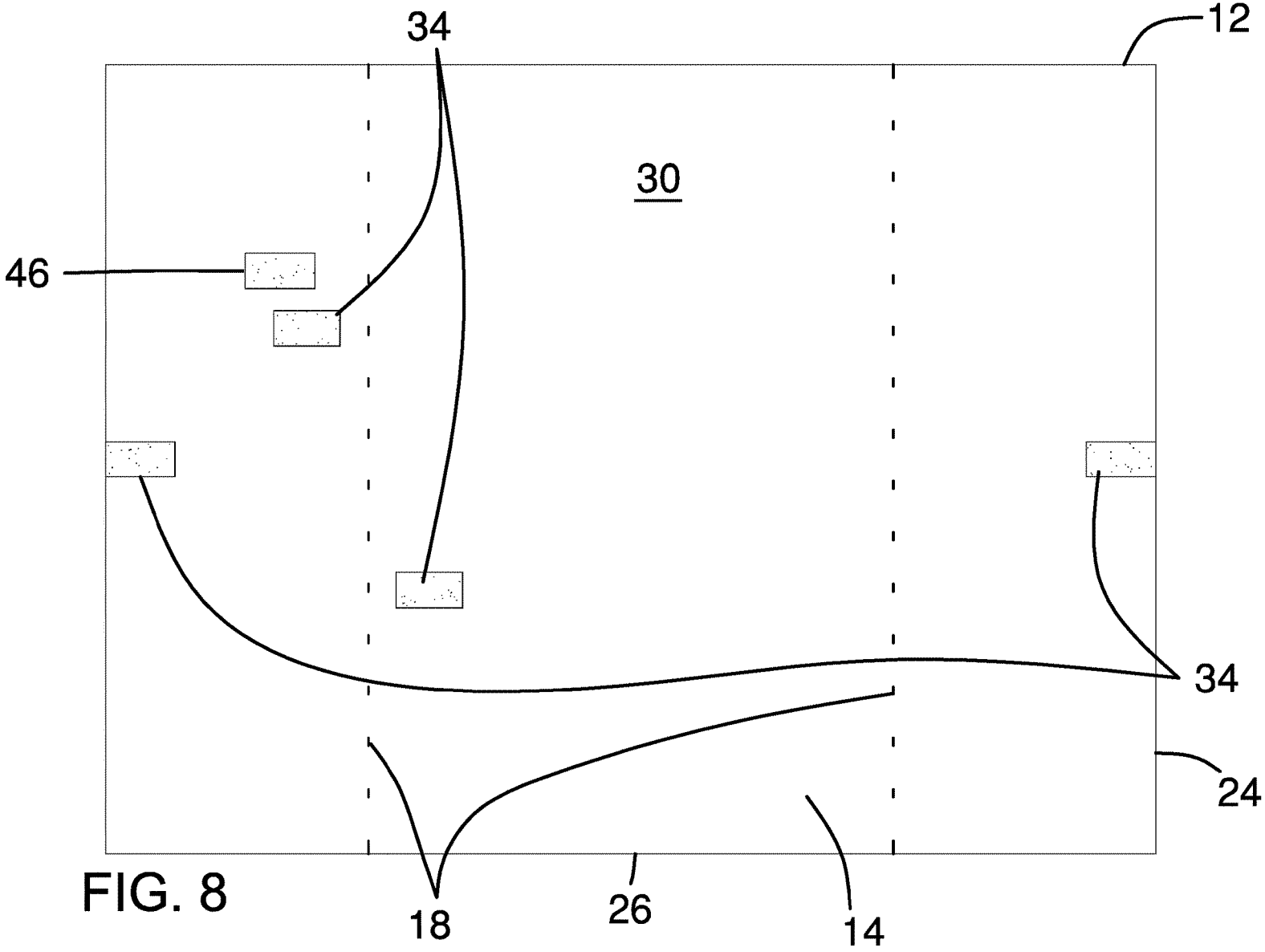
FIG. 8 is a rear open view of an embodiment of the disclosure.

As best illustrated in FIGS. 1 through 10, the trifold presentation board assembly 10 generally comprises a panel 12 that comprises a first section 14 and a pair of second sections 16. Each second section 16 is hingedly coupled to a respective opposing edge 18 of the first section 14 and is positioned to be pivoted relative to the first section 14, as shown in FIGS. 9-9*c*, to selectively reposition the panel 12 from an extended configuration, as shown in FIGS. 7 and 8, to a folded configuration, as show in FIGS. 1-6. A forward face 20 of each of the second sections 16 is positioned proximate to a front face 22 of the first section 14 so that the pair of second sections 16 covers the front face 22 of the first section 14.

The panel 12 comprises at least one of paperboard, foamboard, paramagnetic metal, blackboard, and whiteboard. The panel 12 is rectangularly shaped when the panel 12 is in a planar configuration, thus defining a height 24 and a width 26 of the panel 12. The panel 12 has a height 24 of from 30.0 centimeters to 125.0 centimeters and a width 26 of from 45.0 centimeters to 125 centimeters. The panel 12 has a height 24 that is selected from the group of heights 24 consisting of 35.6 centimeters, 55.9 centimeters, 71.1 centimeters, 91.4 centimeters, and 121.9 centimeters. The panel 12 has a width 26 that is selected from the group of widths 26 consisting of 55.9 centimeters, 71.1 centimeters, 83.8 centimeters, 91.4 centimeters, and 121.9 centimeters. The panel 12 has a height 24 of 91.4 centimeters and a width 26 of 121.9 centimeters.

A plurality of couplers 28 that is coupled to a rear surface 30 of the panel 12 is positioned to be selectively mutually coupled when the panel 12 is in the folded configuration. The panel 12 thus is configured to shield and protect a display article that is coupled to a front surface 32 of the panel 12.

The plurality of couplers 28 comprises a pair of first connectors 34 and a second connector 36, which is coupled to a strap 38. Each first connector 34 is coupled to the rear surface 30 of the panel 12 and is positioned proximate to a respective opposing end 40 of the panel 12 substantially equally distant from opposing sides 42 of the panel 12. The first connectors 34 are proximately positioned when the panel 12 is in the folded configuration. The second connector 36 is complementary to the pair of first connectors 34 so that the second connector 36 is positioned to be selectively and removably coupled to the pair of first connectors 34 when the panel 12 is in the folded configuration to fixedly position the panel 12 in the folded configuration. The second connector 36 and the pair of first connectors 34 comprise a securing hook and loop fastener 44.

A third connector 46 that is coupled to the rear surface 30 of the panel 12 is complementary to the second connector 36. The third connector 46 is positioned to be selectively coupled to the second connector 36 to removably couple the strap 38 to the rear surface 30 of the panel 12 to stow the strap 38. The third connector 46 and the second connector 36 comprise a stowing hook and loop fastener 48. The third connector 46 is useful in retaining the strap 38 in proximity to the panel 12 when the strap 38 is not in use.

The assembly 10 also comprises a handle 50 that is selectively couplable to the panel 12 when the panel 12 is in the folded configuration. The handle 50 is configured to be grasped in a hand of a user to transport the panel 12. The handle 50 is substantially C-shaped so that the handle 50 has opposing termini 52.

Each of a pair of first fasteners 54 is coupled to a respective opposing face 56 proximate to a respective terminus 52 of the handle 50. Each of a pair of second fasteners 58 is coupled to the rear surface 30 of the panel 12 so that the pair of second fasteners 58 brackets a respective opposing edge 18 of the first section 14 of the panel 12. The pair of second fasteners 58 is positioned substantially equally distant from the opposing sides 42 of the panel 12. Each second fastener 58 is positioned to selectively couple to a respective first fastener 54 to removably couple the handle 50 to the panel 12. The second fastener 58 and the respective first fastener 54 comprise a hook and loop fastener 60.

In use, the user couples the display article to the front surface 32 of the panel 12. The second sections 16 of the panel 12 then are pivoted to sandwich the display article between the first section 14 and the pair of second section 16 of the panel 12. The panel 12 is secured in the folded configuration using the securing hook and loop fastener 44. If desired, the handle 50 is coupled to the panel 12 using the hook and loop fasteners 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trifold presentation board assembly comprising:

a panel comprising a first section and a pair of second sections, each second section being hingedly coupled to a respective opposing edge of the first section such that the second sections are positioned for pivoting relative to the first section for selectively repositioning the panel from an extended configuration to a folded configuration wherein a forward face of each of the second sections is positioned proximate to a front face of the first section such that the pair of second sections covers the front face of the first section; and a plurality of couplers coupled to a rear surface of the panel such that the couplers are positioned for selectively mutually coupling when the panel is in the folded configuration wherein the panel is configured for shielding and protecting a display article coupled to a front surface of the panel, the plurality of couplers comprising:

a pair of first connectors coupled to the rear surface of the panel, and a second connector coupled to a strap, the second connector being complementary to the pair of first connectors such that the second connector is positioned for selectively removably coupling to the pair of first connectors when the panel is in the folded configuration for fixedly positioning the panel is in the folded configuration.

2. The assembly of claim 1, further including the panel comprising at least one of paperboard, foamboard, paramagnetic metal, blackboard, and whiteboard.

3. The assembly of claim 1, further including the panel being rectangularly shaped when the panel is in a planar configuration defining a height and a width of the panel, the panel having a height of from 30.0 centimeters to 125.0 centimeters and a width of from 45.0 centimeters to 125 centimeters.

4. The assembly of claim 3, further comprising:

the panel having a height selected from the group of heights consisting of 35.6 centimeters, 55.9 centimeters, 71.1 centimeters, 91.4 centimeters, and 121.9 centimeters; and the panel having a width selected from the group of widths consisting of 55.9 centimeters, 71.1 centimeters, 83.8 centimeters, 91.4 centimeters, and 121.9 centimeters.

5. The assembly of claim 4, further including the panel having a height of 91.4 centimeters, the panel having a width of 121.9 centimeters.

6. The assembly of claim 1, further including each first connector being positioned proximate to a respective opposing end of the panel substantially equally distant from opposing sides of the panel such that the first connectors are proximately positioned when the panel is in the folded configuration.

7. The assembly of claim 1, further including the second connector and the pair of first connectors comprising a securing hook and loop fastener.

8. The assembly of claim 1, further including a third connector coupled to the rear surface of the panel, the third connector being complementary to the second connector wherein the third connector is positioned for selectively coupling to the second connector for removably coupling the strap to the rear surface of the panel for stowing the strap.

9. The assembly of claim 8, further including the third connector and the second connector comprising a stowing hook and loop fastener.

10. The assembly of claim 1, further including a handle, selectively couplable to the panel when the panel is in the folded configuration wherein the handle is configured for grasping in a hand of a user for transporting the panel.

11. A trifold presentation board assembly comprising:

a panel comprising a first section and a pair of second sections, each second section being hingedly coupled to a respective opposing edge of the first section such that the second sections are positioned for pivoting relative to the first section for selectively repositioning the panel from an extended configuration to a folded configuration wherein a forward face of each of the second sections is positioned proximate to a front face of the first section such that the pair of second sections covers the front face of the first section;

a plurality of couplers coupled to a rear surface of the panel such that the couplers are positioned for selectively mutually coupling when the panel is in the folded configuration wherein the panel is configured for shielding and protecting a display article coupled to a front surface of the panel;

a handle selectively couplable to the panel, the handle being substantially C-shaped such that the handle has opposing termini;

a pair of first fasteners, each first fastener being coupled to a respective opposing face proximate to a respective terminus of the handle; and a pair of second fasteners coupled to the rear surface of the panel such that the pair of second fasteners bracket a respective opposing edge of the first section of the panel, the pair of second fasteners being positioned substantially equally distant from the opposing sides of the panel wherein each second fastener is positioned for selectively coupling to a respective first fastener for removably coupling the handle to the panel.

12. The assembly of claim 11, further including the second fastener and the respective first fastener comprising a hook and loop fastener.

13. A trifold presentation board assembly comprising:

a panel comprising a first section and a pair of second sections, each second section being hingedly coupled to a respective opposing edge of the first section such that the second sections are positioned for pivoting relative to the first section for selectively repositioning the panel from an extended configuration to a folded configuration wherein a forward face of each of the second sections is positioned proximate to a front face of the first section such that the pair of second sections covers the front face of the first section wherein the panel is configured for shielding and protecting a display article coupled to a front surface of the panel, the panel comprising at least one of paperboard, foamboard, paramagnetic metal, blackboard, and whiteboard, the panel being rectangularly shaped when the panel is in a planar configuration defining a height and a width of the panel, the panel having a height of from 30.0 centimeters to 125.0 centimeters and a width of from 45.0 centimeters to 125 centimeters, the panel having a height selected from the group of heights consisting of 35.6 centimeters, 55.9 centimeters, 71.1 centimeters, 91.4 centimeters, and 121.9 centimeters, the panel having a width selected from the group of widths consisting of 55.9 centimeters, 71.1 centimeters, 83.8 centimeters, 91.4 centimeters, and 121.9 centimeters, the panel having a height of 91.4 centimeters, the panel having a width of 121.9 centimeters;

a plurality of couplers coupled to a rear surface of the panel such that the couplers are positioned for selectively mutually coupling when the panel is in the folded configuration wherein the panel is configured for shielding and protecting a display article coupled to a front surface of the panel, the plurality of couplers comprising:

a pair of first connectors coupled to the rear surface of the panel, each first connector being positioned proximate to a respective opposing end of the panel substantially equally distant from opposing sides of the panel such that the first connectors are proximately positioned when the panel is in the folded configuration, and a second connector coupled to a strap, the second connector being complementary to the pair of first connectors such that the second connector is positioned for selectively removably coupling to the pair of first connectors when the panel is in the folded configuration for fixedly positioning the panel is in the folded configuration, the second connector and the pair of first connectors comprising a securing hook and loop fastener;

a third connector coupled to the rear surface of the panel, the third connector being complementary to the second connector wherein the third connector is positioned for selectively coupling to the second connector for removably coupling the strap to the rear surface of the panel for stowing the strap, the third connector and the second connector comprising a stowing hook and loop fastener;

a handle, selectively couplable to the panel when the panel is in the folded configuration wherein the handle is configured for grasping in a hand of a user for transporting the panel, the handle being substantially C-shaped such that the handle has opposing termini;

a pair of first fasteners, each first fastener being coupled to a respective opposing face proximate to a respective terminus of the handle; and a pair of second fasteners coupled to the rear surface of the panel such that the pair of second fasteners bracket a respective opposing edge of the first section of the panel, the pair of second fasteners being positioned substantially equally distant from the opposing sides of the panel wherein each second fastener is positioned for selectively coupling to a respective first fastener for removably coupling the handle to the panel, the second fastener and the respective first fastener comprising a hook and loop fastener.

* * * * *